United States Patent [19]

Anderson

[11] 4,276,846

[45] Jul. 7, 1981

[54] RECOVERY APPARATUS

[76] Inventor: Douglas E. Anderson, "Little Timbers", Horley Row, Horley, Surrey RH6 8DH, England

[21] Appl. No.: 82,153

[22] Filed: Oct. 5, 1979

Related U.S. Application Data

[63] Continuation of Ser. No. 850,047, Nov. 9, 1977, abandoned.

[30] Foreign Application Priority Data

| | | | |
|---|---|---|---|
| Oct. 27, 1973 | [GB] | United Kingdom | 50119/73 |
| Nov. 26, 1973 | [GB] | United Kingdom | 54704/73 |
| Jun. 3, 1974 | [GB] | United Kingdom | 24576/74 |

[51] Int. Cl.[3] ..... B63C 7/08

[52] U.S. Cl. ..... 114/52; 114/123; 114/125

[58] Field of Search ..... 114/45, 49–54, 114/61, 123, 125, 331, 333, 283, 67 A

[56] References Cited

U.S. PATENT DOCUMENTS

| | | | |
|---|---|---|---|
| 863,532 | 8/1907 | Hector | 114/331 |
| 1,691,738 | 11/1928 | Powell | 114/53 |
| 2,280,547 | 4/1942 | Scofield | 114/52 |
| 3,541,986 | 11/1970 | Kriedt et al. | 114/52 |
| 3,782,317 | 1/1974 | Kriedt et al. | 114/52 |

*Primary Examiner*—Sherman D. Basinger

*Attorney, Agent, or Firm*—Roylance, Abrams, Berdo & Farley

[57] ABSTRACT

An apparatus for use in recovering an article at least partially submerged in water comprises at least two floatable members each having an arm mounted thereon and whose buoyancy can be varied, each arm carrying a recovery member having gripping or scooping means. A pivot interconnects said arms so that their motion opposes that of the recovery members. A locking device for progressively and releasably locking the arms with respect to each other is provided such that on release thereof the pivot moves downwardly by gravity, causing the recovery members to come together in a caliper-like action. Pressure sensing means in recovery members feeds back information to the locking device to cause the arms to lock and prevent an increase in pressure is attained. A further embodiment does not need a locking device. Each of the floatable members is pivotally connected to one of the arms in an upward direction to a maximum elevation, the pivotable floatable members being arranged to stabilize the apparatus when they are elevated against rolling thereof. A further locking device is provided to hold each of the pivotable floatable members at least in the horizontal and in the maximum elevated positions. A method for recovering submerged articles using such an apparatus and a method for adjusting the buoyancy of an apparatus and improving its submerged stability by the use of pivotable floatable members is also disclosed.

11 Claims, 3 Drawing Figures

RECOVERY APPARATUS

This is a continuation of application Ser. No. 850,047, filed Nov. 9, 1977 and now abandoned.

This invention relates to an apparatus for use in recovering articles stranded in water or submerged articles or materials. The invention is particularly concerned with a rig for use in salvaging vessels at sea or in rivers or for use as a dredger but a small-scale version for the same apparatus can be used as a toy.

In another aspect, the invention is concerned with adjusting the buoyancy and stability of a floating vessel or a vessel immersed in a liquid by providing such vessel with novel floatable members of particular adjustable disposition with respect to the vessel.

U.S. Pat. No. 1,691,738 (Powell) describes an apparatus for use in recovering articles stranded in water or submerged articles or materials, which apparatus comprises particular pontoon structures buoyancy of which can be varied and each of which have arms mounted thereon, all of the arms being connected to tong-like gripping members, the arms being connected by means of a pivot and being so arranged as to oppose the tong-like gripping members such that the buoyancy of the pontoons can be varied and the tong-like gripping members caused to come together in a tong-like action. Unfortunately, such structures, when in use without other guiding means, tend to be unstable and to exhibit excessive rolling and lack of control. Exact buoyancy control is necessary in these circumstances, and this can be a difficult matter to achieve in practice. The Powell apparatus employs buoyed anchors connected to winches located on each end of each pontoon to guide the apparatus over the vessel to be recovered. These winches are controlled by an operator in a special chamber in the apparatus.

Furthermore, with such a structure as described by Powell, fine control of the actual engagement of the apparatus with the vessel to be recovered is solely dependent upon the operation of a complex system of valves to adjust pontoon buoyancy.

In one embodiment of the present invention, the need for careful operation of a system of valves to achieve the actual "pick-up" step of a recovery operation is removed. The caliper-like structure having lockable caliper arms provided by the present invention permits a relatively simple operation using the locks and buoyancy alteration in a controlled manner; at any time the caliper arms can be locked in position.

Furthermore, in preferred embodiments, by carefully positioning pivotable floatable members (tanks) around a salvage apparatus (or, indeed, any apparatus which may be submerged during use), and enabling these members to pivot in a particular manner, a greatly enhanced degree of control is achieve and a salvage rig operating under water may be used without undue rolling and without winches as suggested by Powell.

The invention provides, in one aspect, an apparatus for use in recovering an at least partially submerged article or material such as an article stranded in water, which apparatus comprises at lest two floatable members each having an arm mounted thereon and whose buoyancy can be varied, each of said arms carrying a recovery member selected from gripping and scooping means, a pivot connecting said arms, said arms being so arranged as to oppose their respective recovery members, means for progressively and releasably locking said arms with respect to each other, said arrangement of said arms being such that on release of said locking means the pivot is adapted to move downwardly under the influence of gravity thereby causing said recovery members to tend to come together in a caliper-like action, pressure sensing means in said recovery members adapted to feed back information to said locking means to cause said locking means to lock and prevent an increase in pressure between said recovery members once a predetermined pressure is attained, said arms and said floatable members being relatively disposed such that said apparatus is adapted to hold a salvaged article substantially at the liquid surface.

In a further preferred aspect the invention also provides in an apparatus for use in recovering an at least partially submerged article or material such as an article stranded in water, at least two floatable members each having a longitudinal axis and whose buoyancy can be varied and each of said members having an arm connected to an end portion thereof, each of said arms carrying a recovery member selected from gripping and scooping means and being connected by means of a pivot to the remainder of said arms, said arms being so shaped and arranged as to oppose two or more of said respective recovery members such that a portion of said apparatus in the region of the pivot is adapted to move downwardly under the influence of gravity thereby causing said opposed recovery members to tend to come together in a caliperlike action, the improvement comprising providing for each of at least two of said floatable members a pivotal connected to one of said arms such that said at least two of said floatable members are pivotable floatable members which are pivotable in an upward direction about said pivotal connections in a substantially vertical plane to a maximum elevation when the angle between said longitudinal axis and the horizontal in said vertical plane is less than 90°, said pivotable floatable members being so arranged about said apparatus as to stabilise said apparatus when they are elevated against rolling thereof, a floatable member locking means being provided to hold each of said pivotable floatable members at least in the horizontal and said maximum elevated positions.

It is another important object of the invention to provide a method for adjusting the buoyancy of an apparatus and for improving the stability thereof against rolling when said apparatus is submerged, which method comprises providing said apparatus with at least two floatable members, each of said at least two floatable members having a longitudinal axis and being of variable buoyancy, said at least two floatable members being pivotally connected to said apparatus so as to be capable of pivoting in a substantially vertical plane to a maximum angle of elevation wherein the angle between said longitudinal axis and the horizontal in said vertical plane is less than 90°, said pivotable floatable members being so arranged about said apparatus as to stabilise the same, when it is submerged and said pivotable floatable members are elevated, against rolling thereof, a floatable member locking means being provided to hold each of said pivotable floatable members at least in the horizontal and maximum elevated positions.

In general, the action of gravity in causing the pivot of the present invention to tend to move downwardly may be accentuated by increasing the buoyancy of the floatable members when the apparatus is in use thus providing an upward force which tends to assist the caliper-like action by virtue of the arrangement of the arms.

The progressive but releasable locking means can, for example, involve a hydraulic system.

A large scale version of the present apparatus can be used in one embodiment as a salvage rig for the recovery of stranded ships, particularly oil tankers. In such an application of the present apparatus gripping means may be provided at the extremity of the arms carried by the floatable members. Each such gripping means may be in the form of a compression mattress, or may be provided with a means to adjust its buoyancy. Thus, control of the apparatus may be achieved by adjusting the buoyancy of the floatable members and the gripping means either independently or, alternatively, means may be provided to transfer air or water ballast from the floatable members to the gripping means or vice versa.

Preferably, the width of the rig may be adjusted in the region of the pivot in order to adapt it to deal with vessels of various sizes.

In addition, the arms mounted at their bases on the floatable members are preferably in the form of supporting legs set at an angle to the vertical and leaning inwardly from the floatable members towards the centre of the apparatus. The legs may carry inwardly directed cross-pieces which are connected by the pivot and extend beyond the pivot to carry downwardly directed extensions which carry the gripping means thereon. Alternatively, the supporting legs, cross-pieces and downwardly directed extensions may be in the form of an integral construction. In either case, however, the arm construction from floatable member to gripping means is roughly "U"-shaped and two or more such constructions are pivoted together at a point adjacent the bottom of one side arm of the "U" to give a caliper-like construction with opposed gripping means.

Preferably, the floatable members are in the form of elongated pontoons. An apparatus in accordance with the present invention utilising a pair of such pontoons supporting one or more pairs of pivoted arms of the type described above and carrying gripping means may be used for salvaging oil tankers or other vessels of fairly uniform cross-sectional size and shape. The preferred construction for such use involves two pairs of pivoted arms, the two pairs being positioned one at each end of a pair of elongated pontoons arranged in parallel. The two pairs are pivoted about a common shaft which runs for the length of the apparatus substantially parallel to, and between and above, the pontoons. Locking means are preferably provided between the downwardly directed extension of each arm which carries the gripping means and the cross-piece of the opposite arm of each pair of arms. Reinforcing superstructure may be provided between the pairs of arms along each pontoon.

The procedure for using such an apparatus in recovering a ship or oil tanker could, for example, involve the following steps:

(a) the width of the rig is, if necessary, adjusted to suit the vessel to be recovered;

(b) the rig is positioned to float sitting astride the vessel with each pair of downwardly directed arm extensions being positioned with one arm extension on each side of the vessel;

(c) the buoyancy of the pontoons is adjusted to raise or lower the rig to suit the particular vessel and, optionally, the buoyancy of the gripping means is adjusted to prevent the central section of the apparatus collapsing too far;

(d) the locking means is released;

(e) the gripping means is allowed to contact the sides of the vessel;

(f) the locking means is locked again; and (g) the buoyancy of the overall combination of vessel and rig is adjusted by adjusting the buoyancy of the pontoons.

The contacting of the gripping means with the sides of the vessel may be controlled by providing pressure sensors in the gripping means which automatically feedback information to the locking means causing this to lock and prevent further increasing pressure on the vessel sides, and eliminating the danger of crushing the vessel, when a predetermined pressure is attained.

The gripping means may also serve to block a hole in the vessel's side if, for example, an appropriately-sized pad is used as the gripping means.

An apparatus of the present type can be used to salvage vessels which are submerged by simply reducing the buoyancy and increasing ballast in the pontoons to such an extent that the entire apparatus sinks. The stages set out above could then be followed and the buoyancy of the combination of apparatus and vessel subsequently being increased sufficiently to raise the entire combination to the surface.

Once on the surface if not already there the apparatus-vessel combination can be taken into a harbour and the vessel supported by other means while the progressive but releasable locking means is slowly released and the buoyancy of the floatable members reduced. This action reverses the caliper-like gripping action and causes the apparatus to sink as the caliper-like construction opens. The buoyancy of the apparatus may then be adjusted to prevent the apparatus completely sinking or collapsing onto the ship whilst the locking means is locked to hold the caliper-like construction open. To assist this action high pressure water or air-jets may be privided on the floatable members to give an inwardly-directed thrust which tends to cause the caliper-like construction to open.

It will be appreciated that the adjustment of buoyancy of the apparatus, if necessary involving buoyancy tanks on the gripping means, is of critical importance in the use of the apparatus. The buoyancy capability may be varied to suit varying operating conditions.

The possibility is envisaged that removal or adjustment of the ship superstructure would be necessary in order to allow use of the present apparatus.

If the vessel to be recovered in less uniform in shape than an oil tanker a single construction utilising segmented pontoons could be employed as an alternative to several smaller rigs. In this way variations in the width of the vessel for salvage could be catered for by adjusting the width of any particular pair of pivotal arms by the desired amount and hence the separation of the respective gripping means.

The present apparatus can be towed to the scene of an accident or of salvage operations or, alternatively, can be provided with its own power source and engines rendering it a completely independent salvage vessel.

Furthermore, the apparatus can be utilized at one end only of a vessel, for example, merely to supplement the buoyancy of a vessel in distress.

In a suitable dry dock with a shoulder provided in the walls thereof the apparatus may be used to support a small ship enabling easy access to the hull from underneath. This is achieved by floating in the vessel-apparatus combination with the dock filled with water and allowing the pontoons to settle on the shoulder in the dock walls as water is drained away.

Usually, the cross-sectional shape of the pontoons is designed to provide a substantially flat underside (reducing the risk of fouling underwater obstacles especially when a shallow draught is also employed by maintaining appreciable buoyancy in the pontoons) with a smoothly curving upper surface. In the dry dock procedure described above specially reinforced pontoons of substantially square or rectangular cross-section may be employed to better stand the strain when the vessel-apparatus combination is in dock and the water then drained away leaving the combination sitting on the dock wall shoulder.

The apparatus of the present invention in the form of a salvage rig can be produced in any size depending upon the size of vessel to be salvaged. Possible uses of such a rig include: (a) underwater and surface salvage of all types of vessel; (b) giving additional buoyancy support to vessels in distress thereby allowing them to be taken safely to harbour for repair; (c) refloating ships which have run aground and reducing the draught of large vessels by clamping the rig onto the ship or vessel and either awaiting high tide or immediately utilising the variable buoyancy of the rig to refloat or reduce the draught of the ship or vessel; (d) inspection (from the pontoon) of ships below water-line during actual salvage operations without the need for divers or frogmen; (e) laying underwater pipes, cables, or tunnels; and (f) remote control salvage of all types of articles.

It will be appreciated that many lifting and salvage operations could be undertaken by such apparatus. No hawsers would be required and operations could be much safer than conventional salvage procedures by virtue of the ability to adjust the rig's buoyancy to suit particular conditions thus avoiding unnecessary stresses and strains.

A rig of the above type could, in addition, be provided with hovercraft capability thus enabling it to manoeuvre around a vessel which had run aground at low tide.

Another embodiment of the present apparatus has, in place of the gripping means scopping means connected to the extremity of each of said arms to thereby provide dredging equipment. The scooping means can, for example, be in the form of large shallow shovel-like scoops or, alternatively, more compact bucket-like containers. The precise choice of scooping means employed depends upon the dredging or digging operation envisaged.

Apparatus of this type could, depending upon its scale, be used in all types of operations from large scale sand or silt dredging in river estuaries or the collection of ice from polar regions for irrigation purposes in hotter climates to open cast underwater mining or digging and transporting aggregates for the building industry. Similarly, such equipment could be employed in building underwater constructions, dumping waste at sea, collecting seaweed for fertiliser, or, indeed, any underwater digging operation.

The use of a dredging or digging apparatus of the above type is analogous to the use of the salvaging embodiment in underwater salvage, i.e. the apparatus is towed or driven to the site and the floatable members flooded to cause the apparatus to submerge followed by operation of the caliper action underwater, or produce a digging action with the scooping means, the buoyancy of the floatable members then restored causing the apparatus and its load to rise to the surface followed by unloading of the load.

This invention includes within its scope any method of salvaging vessels which utilises a salvage rig apparatus substantially as described above.

The invention also includes any digging or dredging procedure which utilises dredging equipment substantially of the type described above.

Also included within the scope of the invention is an apparatus in accordance with the invention constructed on a small scale as a toy and including a length of tubing connected to one or more of the floatable members enabling an operator to adjust the buoyancy thereof, when the toy is in use, by blowing into the tubing or by releasing air from the floatable member or members through the tubing. A larger-scale toy may be radio-controlled and carry a radio-activated source of compressed air for adjusting the buoyancy of the floatable members.

The invention, furthermore, provides a pontoon construction suitable for use in salvage rig apparatus or dredging equipment of the type as described above and comprising an elongated tube closed at both ends which tube contains one or more buoyancy compartments and has a wall comprising a flexible mesh layer, each buoyancy compartment having at least one wall which forms a part of the wall of the tube and being provided with an inflatable pack and a source of compressed gas so that should the wall of the tube be damaged inflation of the inflatable pack can be achieved too, if necessary, completely fill the buoyancy compartment to provide maximum buoyancy and to expel water therefrom through said flexible mesh layer.

Preferably the wall of the tube also includes an outer layer of rigid material, the flexible mesh layer forming an inner layer. An outer wall of rigid construction is not necessary in unmanned pontoons but in large scale pontoons which also include living space for human operators such a dual layer construction is essential and the flexible mesh layer does not extend around the interior of that part of the tube wall which corresponds to such living space.

The rigid outer layer may, for example, be constructed from wood, steel, concrete, fibre glass, or rigid plastics material. The flexible mesh layer may, for example, be constructed from steel mesh, nylon-coated steel, or, in small-scale applications, from plastics material mesh.

With certain materials (e.g. concrete) for the rigid outer wall there is no necessity for a flexible mesh lining. In fact the same buoyancy chamber construction may be employed as outlined above simply using a single rigid layer for a wall.

As mentioned, earlier, preferably the tube has a cross-section which includes a substantially flat underside. Any convenient cross-sectional shape may, however, usually be employed and in the case of the dry dock procedure described earlier a pontoon construction of substantially square or rectangular cross-section with reinforced walls is used.

The pontoon may also include high pressure air or water jets for adjusting the apparatus position underwater and/or high pressure hoses for washing away mud from vessels to be salvaged from sandbanks or which have otherwise run aground.

The locking means for the caliper-like frame of the present apparatus (if present) may, as already indicated be hydraulic in nature. Hydraulic locks permit a degree of fine control of the locking to be achieved. The lock may be mounted above the caliper-like frame or at any convenient point on the side of the frame (especially if the apparatus is of realtively small scale). The lock can be provided with an associated locking quadrant or a rachet-like mechanism to permit locking of the frame in various positions.

On very small apparatus in accordance with the present invention (e.g. toy structures) a compressed air-driven bolt can be employed as a locking member on one part of the caliper-like frame; the bolt being adapted to cooperate with corresponding recesses on another part of the frame to provide a locking facility in various positions.

One example of an appropriate locking means is provided by a progressively releasable lock constituted by a normally closed two-way valve (of the "pressure applied to release" type) used in conjunction with a standard high-lift safety valve—all as manufactured by Samuel Birkett Limited, Queens Street Works, Heckmondwicke, Yorkshire, England.

In general, the preferred embodiment of the present invention wherein pivotable floatable members are provided to promote stability functions and may be employed in the manner already described (with the proviso that references to the locking means for the caliper-like structure are to be ignored if no such lock is present—the presence of a lock is preferred). However, there are some differences due to the use of pivotable floatable members. The differences in operation between the above specific pivotable floatable member embodiment of the present invention and the above-described general apparatus of the invention will be clear to the skilled man from the description which follows.

Preferably the present pivotable floatable member apparatus has four floatable members, two on each side. With this construction the pair of members on each side can pivot upwardly in opposite directions, one pivoting clockwise and the other anti-clockwise. This arrangement provides the desired stability against rolling.

It has been found that the optimum angle of elevation of the floatable members is about 68°, this angle giving maximum stability.

The floatable members should preferably be of such a length that when they are locked at an angle of about 68° the ends thereof opposite the end portions pivotally connected to the arms project above the level of the main central pivot.

If the rig is required for underwater operations such as dredging, gaining mineral aggregates or laying masonry or pipes or if the rig is to be used where the underwater terrain is very irregular, an additional frame or series of frames (e.g. "A"-frames or "U"-frames when the article or materials to be salvaged are relatively bulky) can be attached to the centre of the apparatus. Such frames will have extendible telescopic legs which can be extended when the apparatus nears the e.g. sea or river bed to support the apparatus whilst the caliper-like recovery action is activated. In addition, the caliper construction itself (i.e. the arms connected to the floatable members) may have extendible legs.

The apparatus may be fitted with underwater television cameras and depth meters.

The apparatus may be adjusted to adopt a buoyancy which enables it to float when submerged without rising to the surface or sinking appreciably. In these circumstances, weights connected to chains of known length may be slung over the sides of the rig to cause it to sink until the weights "bottom" and their weight is no longer supported by the rig. This is one way of ensuring that the rig reaches a predetermined depth (i.e. a specific height above the sea or river bed) and is stabilised at that depth.

Preferably the floatable member locking means can lock the pivotable members in any desired position between maximum elevation and the horizontal position.

The pivotable floating member construction of the present invention enables greater control of the descent and ascent of the rig through the water to be achieved and reduces the likelihood of excessive rolling.

The present apparatus may have its buoyancy so adjusted such that once a salvage operation has been completed in rough water the apparatus has the salvaged material and the greater part of its superstructure below the water surface to thereby allow safe travel of the apparatus at the surface level.

The invention will now be further described and illustrated with references to the accompanying drawings, in which.

Figure 1:
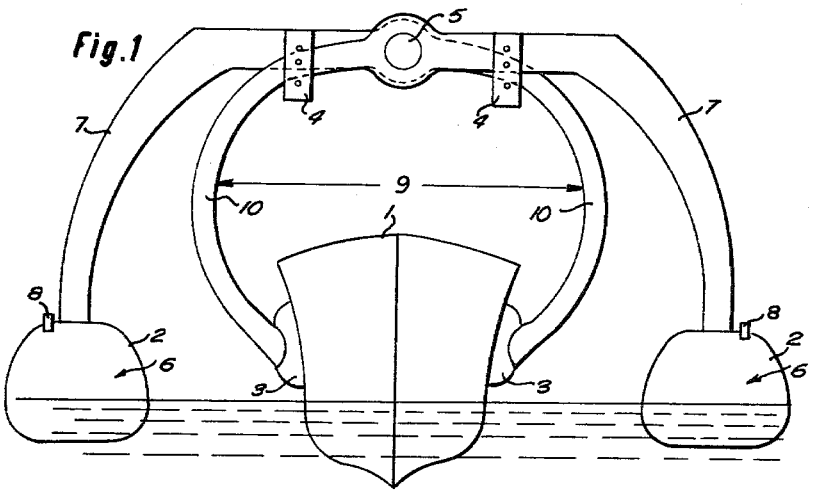
FIG. 1 shows a diagrammatic end-on view of an apparatus in accordance with the invention to illustrate the general principle thereof.

Referring to FIG. 1 of the accompanying drawings, the illustrated apparatus is shown in use salvaging a ship 1. The apparatus has arms 7 which at one end thereof are mounted on pontoons 2 and at the other end thereof terminate in curved portions 10 which carry compression mattresses 3 which serve as the gripping or scooping means. The compression mattresses 3 are positioned to make contact with vessel 1 and can be employed to plug any holes in the side of vessel 1.

The opposed arms 7 are pivoted about a central pivot shaft 5 and provided in an opposed arrangement such that increase in buoyancy of pontoons 2 tends to cause compression mattresses 3 to come together in a caliper-like action. Locking means 4 is provided on each side of pivot shaft 5 and the compression mattresses contain pressure sensor devices (not shown) which feed back information concerning the pressure between the mattresses 3 to the locking means 4. In view of the downward force acting through pivot shaft 5 as a result of the weight of the apparatus in the region of the pivot, will be appreciated that upon release of locking means 4 there is a tendency for pivot shaft 5 to move downwardly. Naturally, this tendency is opposed by any frictional force acting to prevent lateral movement of the pontoons 2.

The width of the apparatus in the caliper-like portion 9 is preferably capable of adjustment to suit different sizes of articles or materials to be recovered.

Pontoons 2 include compressors or compressed air cylinders 8 for supplying air to the interior 6 of each pontoon 2 in order to adjust the overall pontoon buoyancy and hence the overall buoyancy of the apparatus.

In use the apparatus is towed or driven under its own motive power if engines are provided to the side of the vessel or article to be recovered and with locking means 4 locked with the compression mattresses spaced apart. Once at the site of the recovery the apparatus is positioned over the vessel or article to be recovered, locking means 4 is released and the buoyancy of pontoons 2 is increased thereby causing mattresses 3 to come together and grip vessel 1. Of course, if vessel 1 is on the sea bed and not merely run aground the apparatus will function perfectly well underwater and can be positioned underwater (possibly with radio-control) by adjusting the buoyancy of pontoons 2 whilst locking means 4 is locked with the mattresses spaced apart. Once a predetermined pressure has been achieved at mattresses 3 the pressure sensing devices therein (not shown) feedback information to locking means 4 thereby locking the apparatus and vessel 1 together as a single rigid unit. It is, of course, possible to feedback pressure information from the compression mattresses 3 to a controller on the water surface or on land who can then himself cause locking means 4 to be activated. Automatic control and feedback to locking means 4 is not essential.

The single unit constituted by the apparatus gripping vessel 1 may then be raised to the surface by greatly increasing the buoyancy of pontoons 2 with locking means 4 held securely locked. Once upon the surface, or if the salvaged vessel 1 has merely run aground and the entire operation is conducted at surface level, the combination of vessel 1 and the apparatus of the present invention may, of course, be re-located to the desired destination. Release of the vessel can be achieved by lowering the buoyancy of pontoons 2 and opening locking means 4 in a controlled manner.

Figure 2:
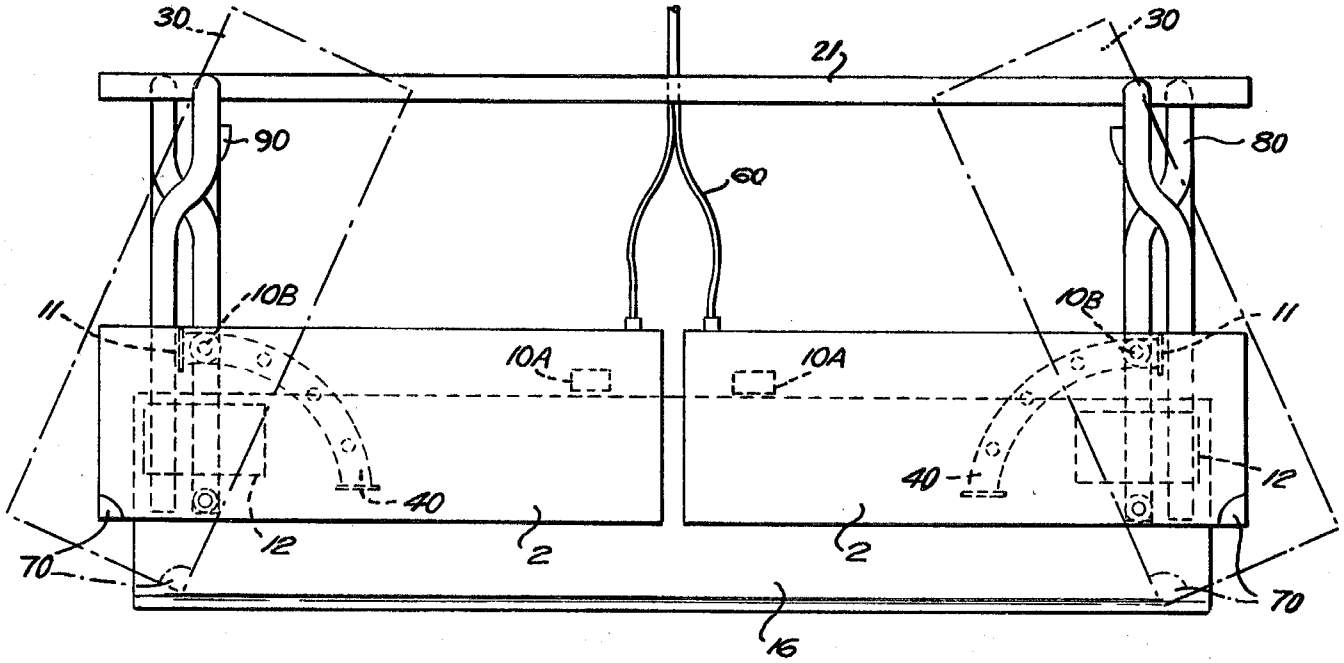
FIG. 2 shows a side view in diagrammatic form of an embodiment of this invention employing pivotable floatable members.

Referring to FIG. 2, the rig main frame 80 comprises the arms which provide the caliper action of the apparatus. Frame 80 is held together by main spar 21. Spar 21 forms the pivot and is actually part of the side of frame 80 marked A in FIG. 3. Spar 21 thus joins together the two arms which constitute side A of frame 80. The two arms constituting side B (FIG. 3) of frame 80 are not integral with spar 21, unlike side A, but can pivot about spar 21 when locking means 90 is released. Buoyancy tanks 2 are provided on each side of the apparatus and are pivotable in opposite directions about axles 50 to a maximum elevation of 68°. The dotted lines outline areas 30 in FIG. 2 showing the tanks 2 in the raised position when they just reach to a higher level than spar 21. Locking quadrants 40 are provided to enable the tanks to be locked at various levels by means of locks 10B. Locks 10A are provided to hold tanks 2 in a horizontal position for surface working of the rig. Stops 11 are provided at the ends of each quadrant 40 to prevent the tanks 2 from passing beyond horizontal or maximum elevated positions.

An airline 60 is provided as an air input and output for each tank 2 and tanks 2 each have an aperture 70 therein.

Clamping pads 12 are provided on each of the four arms (one for each tank 2) which constitute frame 80. In FIG. 2 it can be seen that an elongated dredging scoop 16 is provided running along the length of each side of the apparatus.

Figure 3:
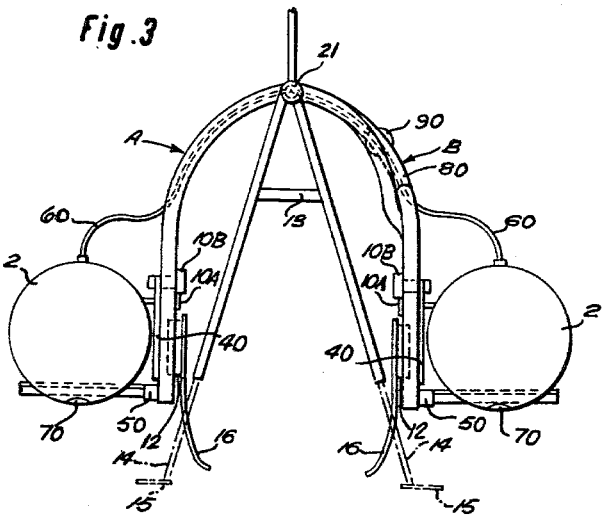
FIG. 3 shows an end-on view of the apparatus shown in FIG. 2 but including an "A"-frame.

In FIG. 3, an "A"-frame 13 can be seen attached to spar 21. There is in fact an "A"-frame 13 at each end of the spar 21 although only one such frame can be seen in the figure. A single "A"-frame can be utilised in the centre of the apparatus as an alternative to one at each end, the frame being shaped to clear the material to be salvaged. Frame 13 has extendible legs 14 (dotted lines indicating the extension) which terminate in feet or sole plates 15.

In use, with tanks 2 initially full of air, as airline 60 is opened water is allowed to flood into tanks 2 through apertures 70 thus displacing air from tanks 2 out through airline 60. This causes the tanks 2 to pivot about axles 50 up to the maximum elevation of about 68° as locks 10A are released and the apparatus begins to sink. Of course, the tanks 2 can be locked at any intermediate elevation by the use of locks 10B and quadrants 40 if appropriate for the particular job in hand.

Airline 60 leads to a control board (not shown) and air can be voided to atmosphere through this system. When a valve (not shown) is closed on the control board air is prevented from escaping through airline 60 from tanks 2 and hence more water is prevented from entering tanks 2 through apertures 70. In this way the buoyancy of the tanks 2 can be adjusted and a controlled descent of the apparatus is achieved.

Once the apparatus has reached the bottom, air is allowed out through airlines 60 and flooded tanks 2 pivot back to the horizontal position where they can be locked by locks 10B and 10A. The downward movement of the tanks 2 is achieved under the influence of gravity but, if desired, motors can be incorporated to control both downward and upward pivoting of tanks 2.

When the apparatus is in position over the wreck for salvage, the locks 90 are released and air is pumped into tanks 2 via airline 60 expelling water through apertures 70. This causes the clamping pads 12 to come together and grip the wreck therebetween as the tanks 2 tend to move outwards as their buoyancy increases. Frame 80 thus acts in a caliper-like manner.

When the wreck has been gripped by pads 12 with sufficient pressure locks 90 are closed to hold the apparatus and wreck together and locks 10B an 10A are disengaged. Air is pumped into tanks 2 via airline 60 and this causes tanks 2 to pivot up to an elevated position where they are locked. Sufficient air can now be pumped into the tanks to cause the wreck and rig to rise to the surface. The ascent can of course be controlled by pumping in more air, or, if the ascent is too rapid, allowing air out through airline 60. In this manner the pressure in tanks 2 seldom varies from that outside them.

Once the apparatus reaches the surface all water is expelled from the tanks 2 and the airline 60 closed to prevent escape of air from tanks 2. The apparatus+-wreck can now be driven or towed to the desired destination.

It is, of course, not always necessary to employ the pivotable nature of tanks 2 in the above-described manner. Provided the centre of gravity of the apparatus+-wreck combination is low enough the tanks 2 need not be pivoted upwards during the ascent. The use of pivotable tanks 2 does, however, allow geater control to be achieved.

Airline 60 may be a common manifold airline to give a balanced flow to each tank 2 or may be a combination of individual airlines to give a greater degree of adjustment to the overall apparatus by supplying air to each tank 2 individually. Alternatively, a combination of common and individual airlines may be employed. The arrangement of valves employed at the control board varies, of course, with the type of airline 60 arrangement used.

If the apparatus has been used to bring the wreck or other salvage to the surface of the sea with tanks 2 raised, the wreck can be held higher in the water by allowing tanks 2 to pivot downwards to the horizontal position. This can be achieved by "beaching" the apparatus on a suitable beach and unlocking locks 10 permitting tanks 2 to return to the horizontal position under the influence of gravity at low tide. The tanks 2 can then be relocked in the horizontal position and the wreck+apparatus floated off at high tide. A series of beaching operations may be necessary to achieve the object of horizontal tanks 2.

It will be appreciated that the use of individual airlines 60 to each tank 2 permits complex manipulation of the position of the apparatus and the degree of roll which it adopts when submerged. Two or more rigs can be employed in the manner described to right submerged craft and salvage them, one salvage rig being used to roll and right the craft and then a second to hold the craft in an upright position while the first rig adjusts its position prior to the ascent.

The present apparatus can be used for dredging, laying pipes or masonry, or gaining mineral aggregates from the sea bed etc. For such uses dredging scoops 16 are employed along with "A"-frames 13 at each end of main spar 21 (see FIG. 3). Recovery of the material from the sea bed etc is carried out by employing the apparatus with the extendible legs 14 retracted. The material can then be deposited at the desired location by allowing the apparatus to sink until the feet 15 on extended legs 14 touch bottom. With their buoyancy reduced tanks 2 will tend to sink inwards causing the caliper-like action of frame 80 to be reversed and scoops 16 to open thus depositing the required material. Legs 14 can be provided with motor-driven extensions or the extensions can then be retracted by unlocking them (the leg extensions 14 are provided with locking devices—not shown) and reducing the buoyancy of the apparatus causing the legs 14 to be retracted as the apparatus sinks with feet 15 resting on the bottom.

For very deep water working a ball valve arrangement (not shown) can be housed in each tank 2 to combat the expansion of air in tanks 2 as the outside pressure drops while the apparatus ascends from deep water. In this way the valve would check a too rapid ascent and assist in equilibrating pressure inside and outside tanks 2.

I claim:

1. In an apparatus for use in recovering an at least partially submerged article or material such as an article stranded in water, at least two floatable members each having a longitudinal axis and whose buoyancy can be varied and each of said members having an arm connected to an end portion thereof, each of said arms carrying a recovery member selected from gripping and scooping means and being connected by means of a pivot to the remainder of said arms, said arms being so shaped and arranged as to oppose two or more of said respective recovery members such that a portion of said apparatus in the region of the pivot is adapted to move downwardly under the influence of gravity thereby causing said opposed recovery members to tend to come together in a caliper-like action, the improvement comprising providing for each of at least two of said floatable members a pivotal connection to one of said arms such that said at least two of said floatable members are pivotable floatable members which are pivotable in an upward direction about said pivotal connections in a substantially vertical plane to a maximum elevation when the angle between said longitudinal axis and the horizontal in said vertical plane is less than 90° said pivotable floatable members being so arranged about said apparatus as to stabilise said apparatus when they are elevated against rolling thereof, a floatable member locking means being provided to hold each of said pivotable floatable members at least in the horizontal and said maximum elevated positions.

2. The apparatus of claim 1 wherein said arms are provided with progressive and releasable locking means adapted for locking said arms with respect to each other.

3. The apparatus of claim 1 wherein there are four of said pivotable floatable members, a pair of said pivotable floatable members being provided on each side of said apparatus, and wherein a first member of each of said pairs of pivotable floatable members can pivot clockwise and a second member of each of said pairs of pivotable floatable members can pivot anti-clockwise.

4. The apparatus of claim 1 wherein the said pivotable floatable members may each be fixed at an angle of elevation of about 68°.

5. The apparatus of claim 4 wherein said pivotable floatable members are each of such a length that when they are at an angle of elevation of about 68° an end thereof opposite to said end portion connected to the respective one of said arms projects above the level of said pivot.

6. The apparatus of claim 1 wherein at least one frame, such as an "A" frame, having extendible legs is attached to said apparatus, said at least one frame being capable of supporting said apparatus on a river bed or sea bed.

7. The apparatus of claim 1 wherein a portion of each of said arms remote from its respective one of said floatable members has downwardly projecting extensions provided with extendible legs.

8. The apparatus of claim 1 wherein said pivotable floatable member locking means can lock said pivotable floatable members at any desired angle of elevation between said maximum elevated position and the horizontal.

9. The apparatus of claim 1 wherein a locking quadrant is provided for fixing the angle of elevation of each of said pivotable floatable members at a desired position.

10. The apparatus of claim 1 wherein said recovery members are a pair of elongated scoops, each of said arms being connected to one of said pair of scoops.

11. The apparatus of claim 1 wherein each of said floatable members is provided with an airline adapted to serve as an air input and output for adjusting the buoyancy thereof.

* * * * *